US009375912B2

(12) United States Patent
Peters et al.

(10) Patent No.: US 9,375,912 B2
(45) Date of Patent: Jun. 28, 2016

(54) CANTILEVER CAROUSEL SYSTEM

(71) Applicant: Vidir Machine Inc., Arborg (CA)

(72) Inventors: Paul D. Peters, Arborg (CA); Phillip G. Forster, Niverville (CA); Stanley K. Plett, Arborg (CA)

(73) Assignee: Vidir Machine Inc., Arborg (CA)

( * ) Notice: Subject to any disclaimer, the term of this patent is extended or adjusted under 35 U.S.C. 154(b) by 20 days.

(21) Appl. No.: 14/169,741

(22) Filed: Jan. 31, 2014

(65) Prior Publication Data

US 2014/0166601 A1 Jun. 19, 2014

Related U.S. Application Data

(63) Continuation-in-part of application No. 12/511,105, filed on Jul. 29, 2009, now Pat. No. 8,616,381, and a continuation-in-part of application No. 13/939,426, filed on Jul. 11, 2013, now abandoned.

(51) Int. Cl.
*B41F 13/00* (2006.01)

(52) U.S. Cl.
CPC ..... *B41F 13/0016* (2013.01)

(58) Field of Classification Search
CPC ..... B41F 13/0016
USPC ..... 211/1.51, 1.52, 1.53, 1.54, 1.55, 1.56, 211/121, 6, 16, 54.1, 57.1, 59.1, 88.04; 312/97, 97.1, 134, 266, 267, 268; 242/594.2–594.6, 597, 597.1, 597.2; 198/347.1, 347.2; 101/216, 479, 480
See application file for complete search history.

(56) References Cited

U.S. PATENT DOCUMENTS

| | | | | |
|---|---|---|---|---|
| 404,480 | A | 6/1889 | Harrington | |
| 637,580 | A | 11/1899 | Hett | |
| 643,049 | A | 2/1900 | Feeser | |
| 1,030,376 | A | 6/1912 | Baecker | |
| 1,069,961 | A * | 8/1913 | Kuczynski | 242/597.4 |
| 1,744,996 | A | 1/1930 | Ward | |
| 3,084,802 | A * | 4/1963 | Ittner | 211/4 |
| 3,223,247 | A | 12/1965 | Bleed | |
| 3,874,496 | A | 4/1975 | Bodin | |
| 4,026,617 | A | 5/1977 | Bosio | |
| 4,218,027 | A * | 8/1980 | Pool | 242/597.4 |

(Continued)

FOREIGN PATENT DOCUMENTS

| | | |
|---|---|---|
| DE | 4239731 | 6/1994 |
| WO | WO2008043714 | 4/2008 |

*Primary Examiner* — Joshua Rodden
(74) *Attorney, Agent, or Firm* — Neustel Law Offices; Michael S. Neustel

(57) ABSTRACT

A cantilever carousel system for efficiently storing multiple print cylinders while providing a common access point for loading and unloading the print cylinders. The cantilever carousel system generally includes an external frame structure defining an internal cavity and a shell connected to the external frame structure to surround the cavity, wherein the shell includes at least one access opening extending therethrough. An internal frame structure is positioned within the cavity and a vertically oriented carousel is supported by the internal frame structure. A drive assembly is mechanically connected to the carousel, wherein the drive assembly circulates the carousel and a plurality of cantilever mandrels are supported by the carousel and circulate with the carousel. A plurality of print cylinders are removably received by the plurality of cantilever mandrels through the access opening.

17 Claims, 15 Drawing Sheets

(56) References Cited

U.S. PATENT DOCUMENTS

| | | | | | |
|---|---|---|---|---|---|
| 4,222,490 | A | * | 9/1980 | Wood, Jr. | 211/70.5 |
| 4,284,206 | A | | 8/1981 | Wittern | |
| 4,312,550 | A | | 1/1982 | Jackson | |
| 4,779,938 | A | | 10/1988 | Johnston | |
| 5,031,847 | A | | 7/1991 | Tanaka | |
| 5,285,981 | A | | 2/1994 | Pavelka | |
| 5,310,066 | A | | 5/1994 | Konstant | |
| 5,316,232 | A | | 5/1994 | Lambert, Jr. | |
| 5,339,968 | A | | 8/1994 | Voelz | |
| 5,431,493 | A | | 7/1995 | Larson | |
| 5,477,709 | A | * | 12/1995 | Rowe | 68/212 |
| 5,676,258 | A | * | 10/1997 | Leyden et al. | 211/7 |
| 6,393,877 | B1 | * | 5/2002 | Church | 70/62 |
| 6,622,979 | B2 | * | 9/2003 | Valiulis | 248/220.42 |
| 6,847,861 | B2 | | 1/2005 | Lunak | |
| 6,918,732 | B2 | | 7/2005 | Jendroska | |
| 7,290,488 | B2 | | 11/2007 | Petersen | |
| 7,370,581 | B2 | | 5/2008 | Plasswich | |
| 7,543,531 | B2 | | 6/2009 | Blanchard | |
| 8,141,239 | B2 | | 3/2012 | Rogge | |
| 2002/0056392 | A1 | | 5/2002 | Sameit | |
| 2002/0129720 | A1 | | 9/2002 | Jendroska | |
| 2003/0047094 | A1 | | 3/2003 | Niemiro | |
| 2008/0134919 | A1 | | 6/2008 | Jendroska | |
| 2009/0224498 | A1 | * | 9/2009 | Diedericks | 280/79.6 |
| 2012/0097622 | A1 | * | 4/2012 | Surma et al. | 211/7 |

* cited by examiner

CANTILEVER CAROUSEL SYSTEM

CROSS REFERENCE TO RELATED APPLICATIONS

I hereby claim benefit under Title 35, United States Code, Section 120 of U.S. patent application Ser. No. 12/511,105 filed Jul. 29, 2009 and Ser. No. 13/939,426 filed Jul. 11, 2013. This application is a continuation-in-part of the Ser. No. 12/511,105 application and the Ser. No. 13/939,426 application. The Ser. No. 12/511,105 application is currently granted as U.S. Pat. No. 8,616,381 and the Ser. No. 13/939,426 application is currently pending. The Ser. Nos. 12/511,105 and 13/939,426 applications are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to print cylinder storage and more specifically it relates to a cantilever carousel system for efficiently storing multiple print cylinders while providing a common access point for loading and unloading the print cylinders.

2. Description of the Related Art

Any discussion of the related art throughout the specification should in no way be considered as an admission that such related art is widely known or forms part of common general knowledge in the field.

Print cylinders for applying die to various mediums, such as newspapers, magazines, food wrappers, or various other mediums have been in use for years. Generally, print cylinders are stored on large stationary storage racks during periods of non use. It can be difficult to load or unload the print cylinders from the storage rack due to the height of the storage rack.

Because the storage racks are stationary, which forces the user to access print cylinders high above the floor surface, the storage racks are often built closer to the floor surface and thus comprise a shorter overall structure. Thus, the need for wider storage racks is necessary which can take up valuable floor space. Because of the inherent problems with the related art, there is a need for a new and improved cantilever carousel system for efficiently storing multiple print cylinders while providing a common access point for loading and unloading the print cylinders.

BRIEF SUMMARY OF THE INVENTION

A system for efficiently storing multiple print cylinders while providing a common access point for loading and unloading the print cylinders. The invention generally relates to print cylinder storage which includes an external frame structure defining an internal cavity and a shell connected to the external frame structure to surround the cavity, wherein the shell includes at least one access opening extending there through. An internal frame structure is positioned within the cavity and a vertically oriented carousel is supported by the internal frame structure. A drive assembly is mechanically connected to the carousel, wherein the drive assembly circulates the carousel and a plurality of cantilever mandrels are supported by the carousel and circulate with the carousel. A plurality of print cylinders are removably received by the plurality of cantilever mandrels through the access opening.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
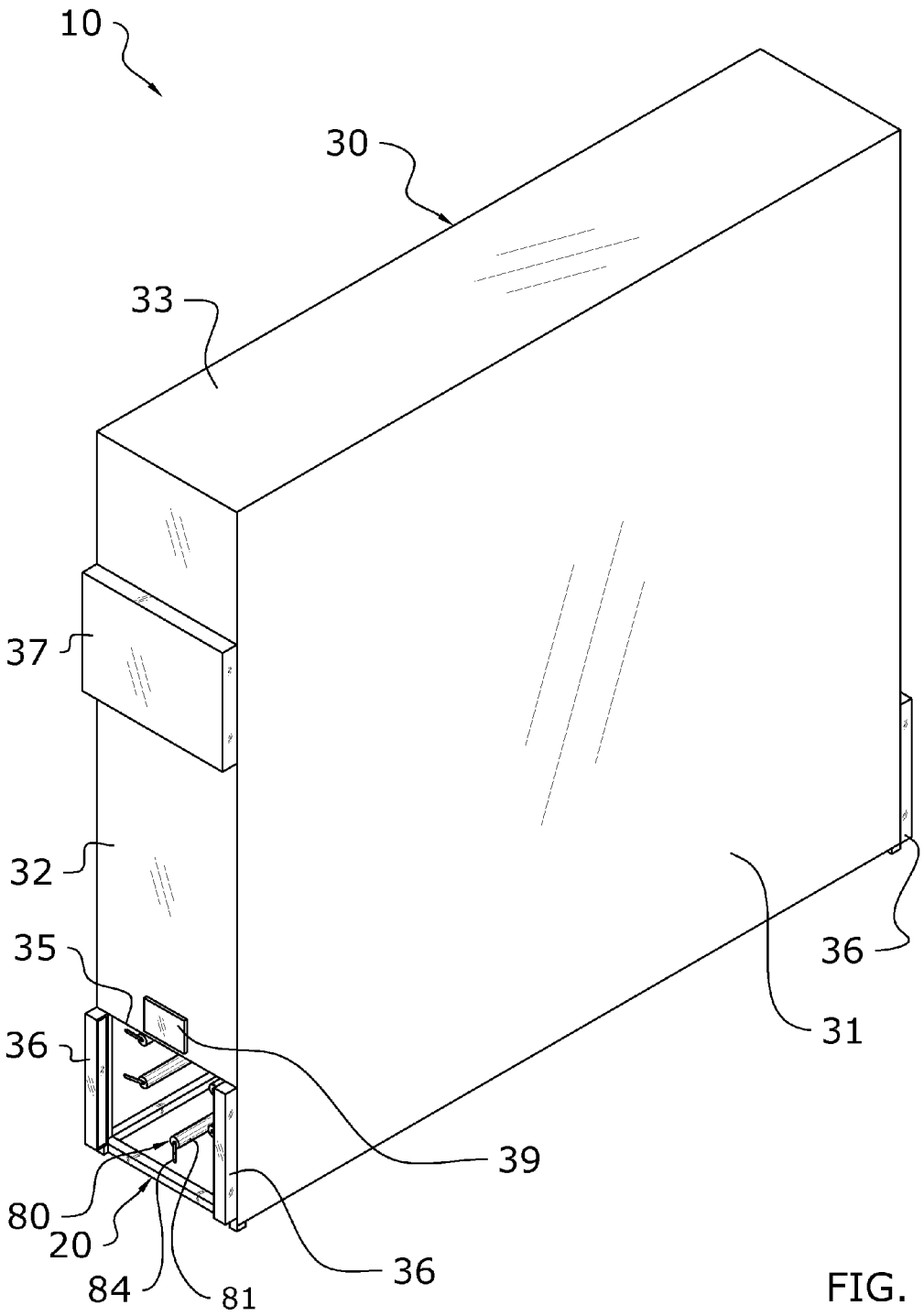
FIG. 1 is an upper perspective view of the present invention.

A. Overview.

Turning now descriptively to the drawings, in which similar reference characters denote similar elements throughout the several views, FIGS. 1 through 15 illustrate a cantilever carousel system 10, which comprises an external frame structure 20 defining an internal cavity 29 and a shell 30 connected to the external frame structure 20 to surround the cavity 29, wherein the shell 30 includes at least one access opening 35 extending there through. An internal frame structure 40 is positioned within the cavity 29 and a vertically oriented carousel 60 is supported by the internal frame structure 40. A drive assembly 50 is mechanically connected to the carousel 60, wherein the drive assembly 50 circulates the carousel 60 and a plurality of cantilever mandrels 80 are supported by the carousel 60 and circulate with the carousel 60. A plurality of print cylinders 12 are removably received by the plurality of cantilever mandrels 80 through the access opening 35. The print cylinders 12 are generally comprised of hollow structures to receive the cantilever mandrels 80 and also generally include a printing die to be used in a printing process. It is appreciated that other types of open ended cylindrical devices or structures may be used rather than the print cylinders 12.

B. External Frame Structure.

The present invention includes an external frame structure 20 which supports the shell 30 and serves as a protective barrier for users around the circulating carousel 60. The external frame structure 20 is generally comprised of a strong rigid material, such as metal, unless otherwise noted. The external frame structure 20 also generally resembles a tower in structure, wherein the external frame structure 20 extends in a general vertical direction from the floor surface and is oriented vertically to encompass the carousel 60.

The external frame structure 20 is generally box-like in shape and includes a front and rear vertical members 21, 23, front and rear horizontal members 22, 24, and cross members 25 connecting the front and rear vertical members 21, 23. Some of the cross members 25 along each end of the external frame structure 20 define access openings 35. Each of the members 21-25 are generally comprised of a square cross-sectional shape and are elongated; however the members 21-25 may take the form of various shapes.

The external frame structure 20 also includes a plurality of cross supports 27 for securing the drive assembly 50 thereon. The drive assembly 50 is preferably supported and secured near the outer edge of the external frame structure 20 to be easily accessible for repairs and maintenance. The external frame structure 20 defines a cavity 29 within for positioning the internal frame structure 40, carousel 60 and cantilever mandrels 80 which also support the print cylinders 12.

C. Shell.

A shell 30 generally surrounds the external frame structure 20 for providing protection for operators and nearby objects from coming into contact with the circulating carousel 60 and cantilever mandrels 80 and likewise to protect the print cylinders 12 stored upon the cantilever mandrels 80. The shell 30 is generally comprised of a thin plate-like material and includes sidewalls 31, end walls 32 and a top 33 to encompass the external frame structure 20.

Each of the end walls 32 also generally include an access opening 35 adjacent the floor surface for accessing the lower most print cylinders 12 upon the lower most cantilever mandrels 80 from each side of the shell 30. The access openings 35 are cut within the end walls 32 and defined by some of the cross members 25. The access openings 35 are large enough for the print cylinders 12 upon the lower most cantilever mandrels 80 to be easily removed from within the external frame structure 20. A first access opening 35 along one end wall 32 is used to access a first portion 81 of a cantilever mandrel 80 and an opposite access opening 35 along a second end wall 32 is used to access a second portion 82 of the cantilever mandrel 80 to load respective first and second print cylinders 12 thereupon.

The shell 30 also generally includes at least one access panel 37 for accessing the drive assembly 50 for repairs and maintenance. The drive assembly 50 is generally aligned with the upper sprockets 62, 67 of the carousel 60 to rotate and drive the upper sprockets 62, 67 which in turn rotate and drive the lower sprockets 63, 68. The access panel 37 preferably conceals the drive assembly 50 to reduce noise and also protect the drive assembly 50 during use and is openable via various manners to allow inspection of the drive assembly 50 if needed.

On respective sides of each of the access openings 35 are sensor units 36. The sensor units 36 work collectively to stop the carousel 60 from circulating if an object or individual passes through the access opening 35. The sensor units 36 may be comprised of various types of sensors all which detect movement or the presence of an individual or object in the access opening 35 or cavity 29 and are capable of sending a signal to the controller 39 to stop the circulation of the carousel 60.

D. Controller.

The present invention also includes a controller 39 preferably positioned proximate the present invention and further preferably located along one of the walls 31, 32 of the shell 30 along an external surface. The controller 39 is used to control the drive assembly 50 and carousel 60 along with other electrical components (e.g. lights) of the present invention. The controller 39 may include various LCD displays along with multiple controls.

E. Drive Assembly.

The drive assembly 50 generally includes a motor 51, which may be comprised of an electric, gas, hydraulic, or other type, connected to a gearbox 54 through an elongated member 52 such as a chain or belt. The motor 51 and the gearbox 54 are preferably supported via cross supports 27 upon the external frame structure 20 adjacent one of the end walls 32 and the access panel 37. As the motor 51 drives the gearbox 54, the gearbox 54 rotates an elongated shaft 55 extending therefrom towards the internal frame structure 40 and carousel 60.

An opposite end of the shaft 55 is connected to a sprocket 56, which in turn is connected to another sprocket 58 via an elongated member 57, such as a chain or belt. The sprocket 58 is coupled to the primary sprocket 62 of the first carrier assembly 61 to rotate the primary sprocket 62 and circulate the first carrier assembly 61 and connected second carrier assembly 66 of the carousel 60.

F. Internal Frame Structure.

The present invention also preferably includes an internal frame structure 40 positioned internally of the external frame structure 20 for supporting the carousel 60. The internal frame structure 40 is preferably vertically oriented within the cavity 29 of the external frame structure 20 and centered therein. The internal frame structure 40 thus generally extends from a lower end to an upper end of the external frame structure 20 to allow for a maximum number of cantilever mandrels 80 to be supported therefrom.

The internal frame structure 40 includes a plurality of first vertical members 41 for supporting the first carrier assembly 61 of the carousel 60 and a plurality of second vertical members 42 for supporting the second carrier assembly 66 of the carousel 60. Cross members connect the first vertical members 41 to the second vertical members 42 for adding support thereto and connecting supports 45 connect the internal frame structure 40 to the external frame structure 20. It is appreciated that the internal frame structure 40 is generally suspended above the floor surface via the connecting supports 45 (e.g. beams, etc.) connecting the internal frame structure 40 to the external frame structure 20.

G. Carousel.

Figure 2:
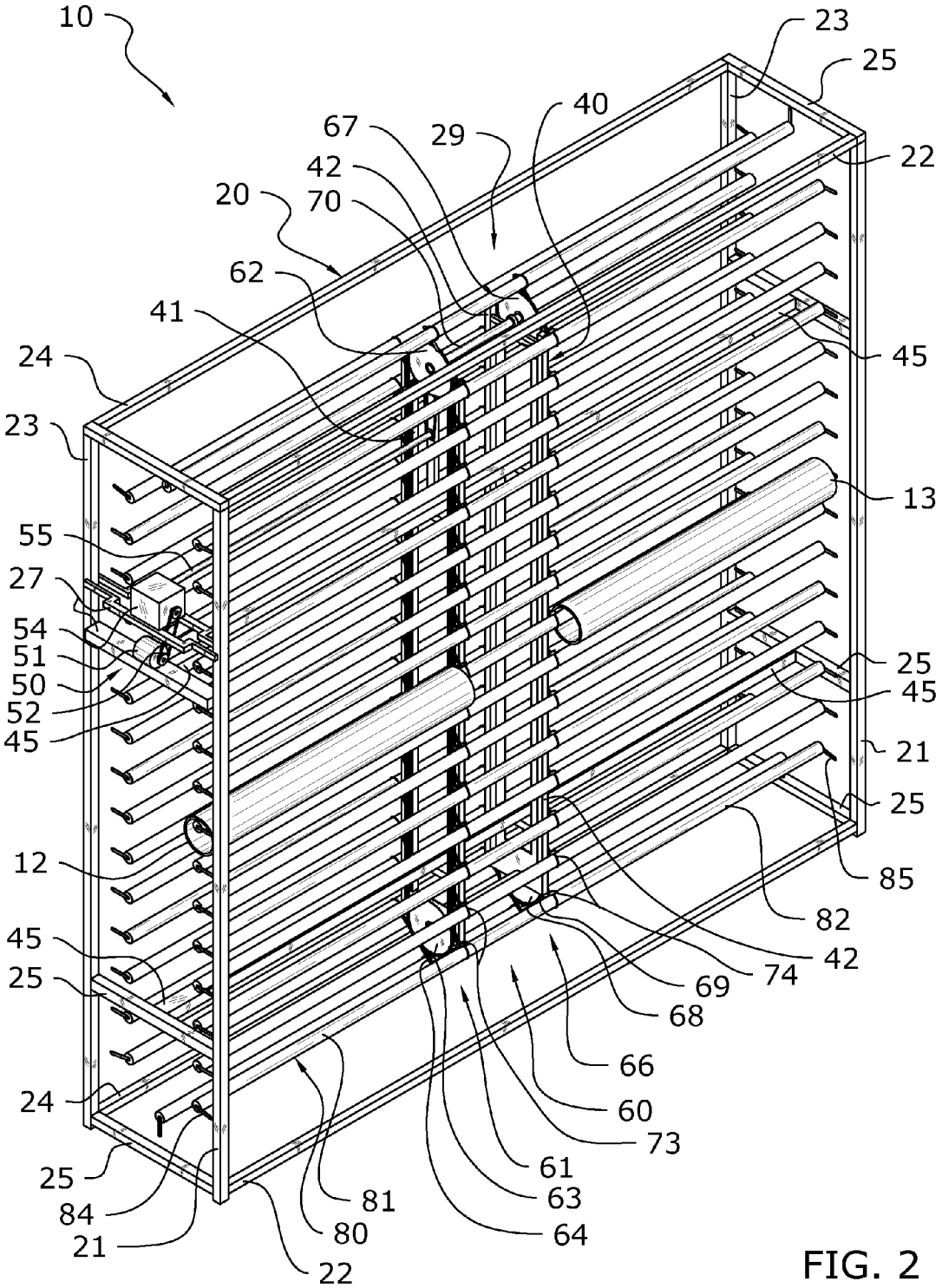
FIG. 2 is an upper perspective view of the present invention with the shell removed.
Figure 3:
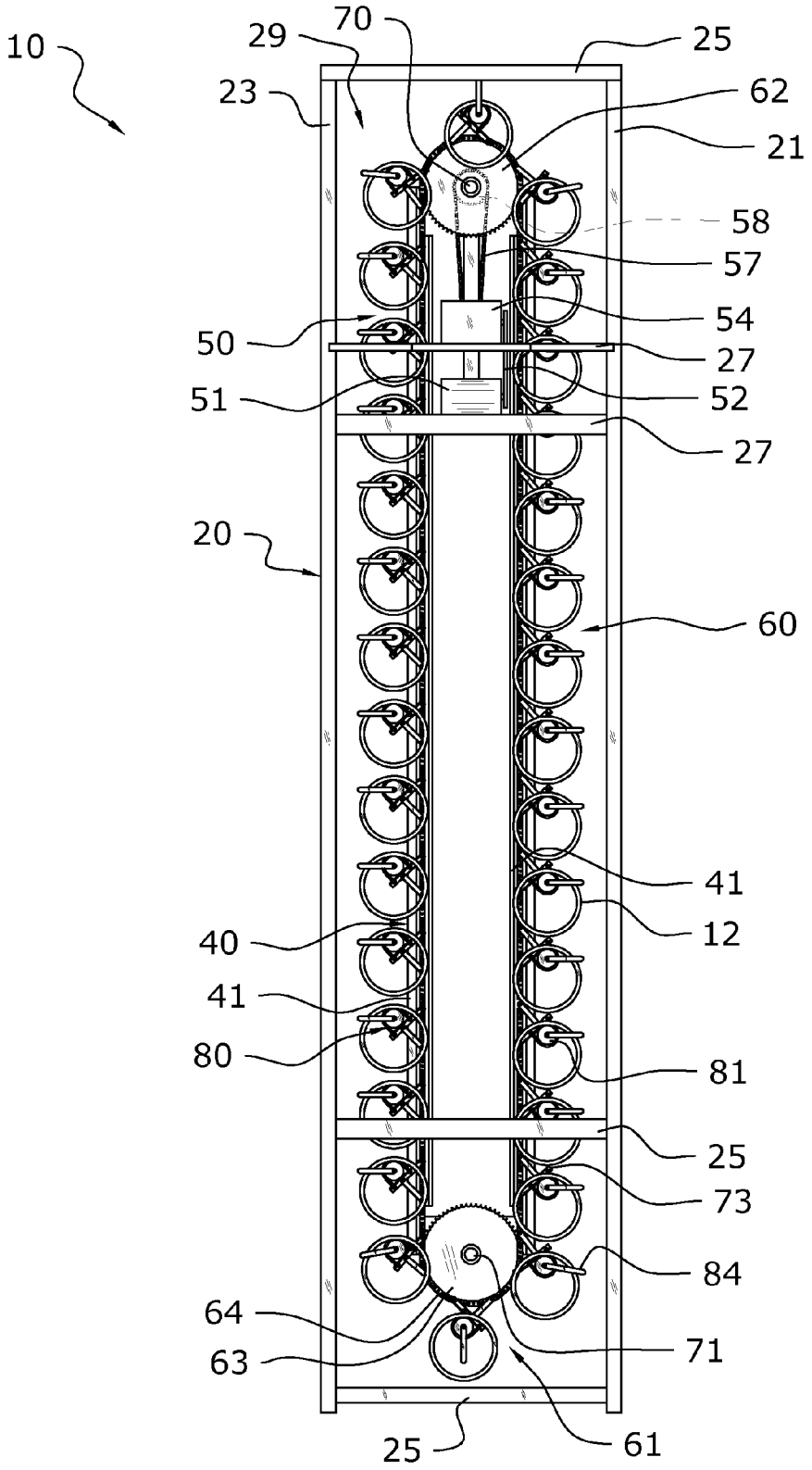
FIG. 3 is a side view of the present invention with the shell removed and a plurality of print cylinders positioned upon the cantilever mandrels.
Figure 4:
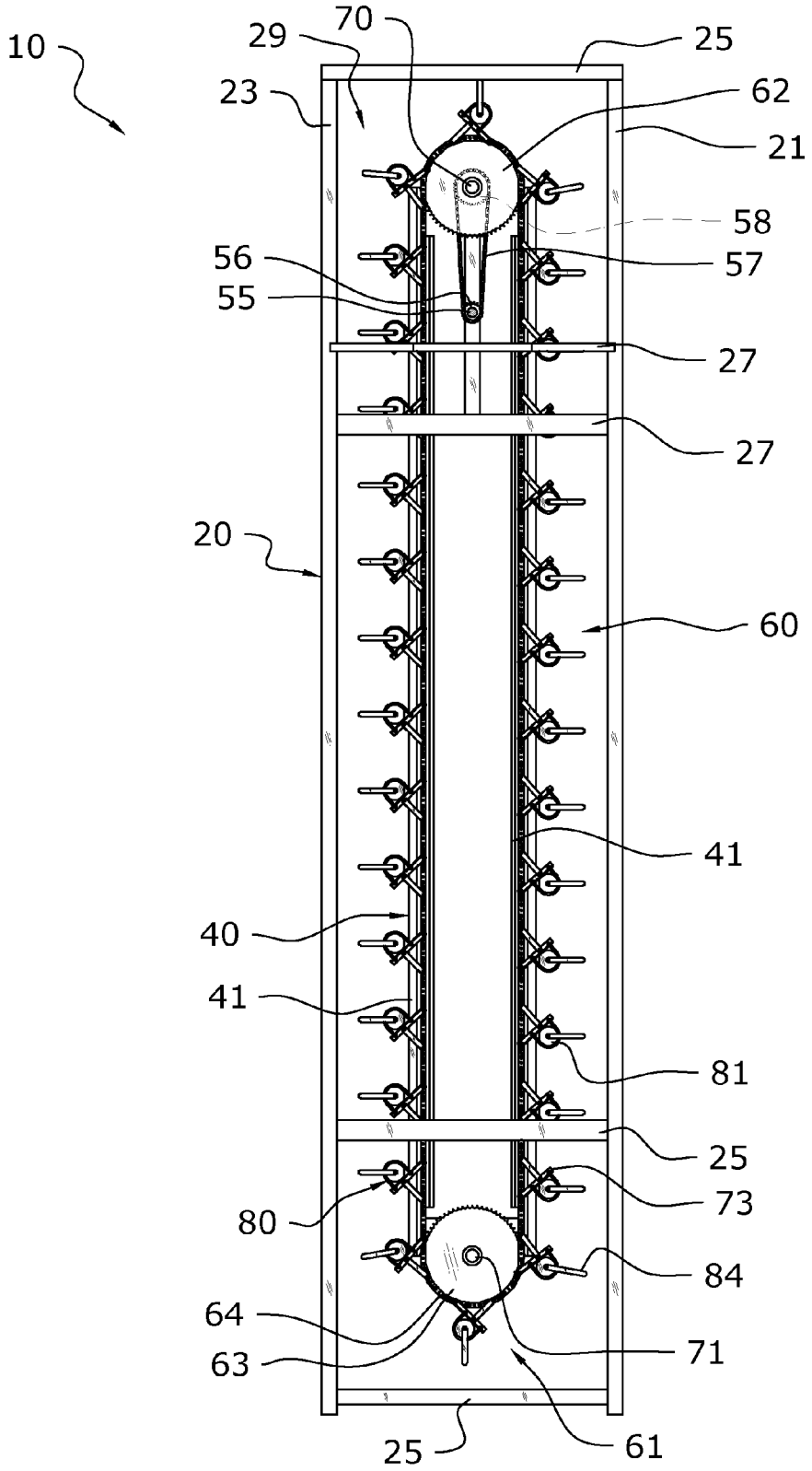
FIG. 4 is a side view of the present invention with the shell removed.
Figure 5:
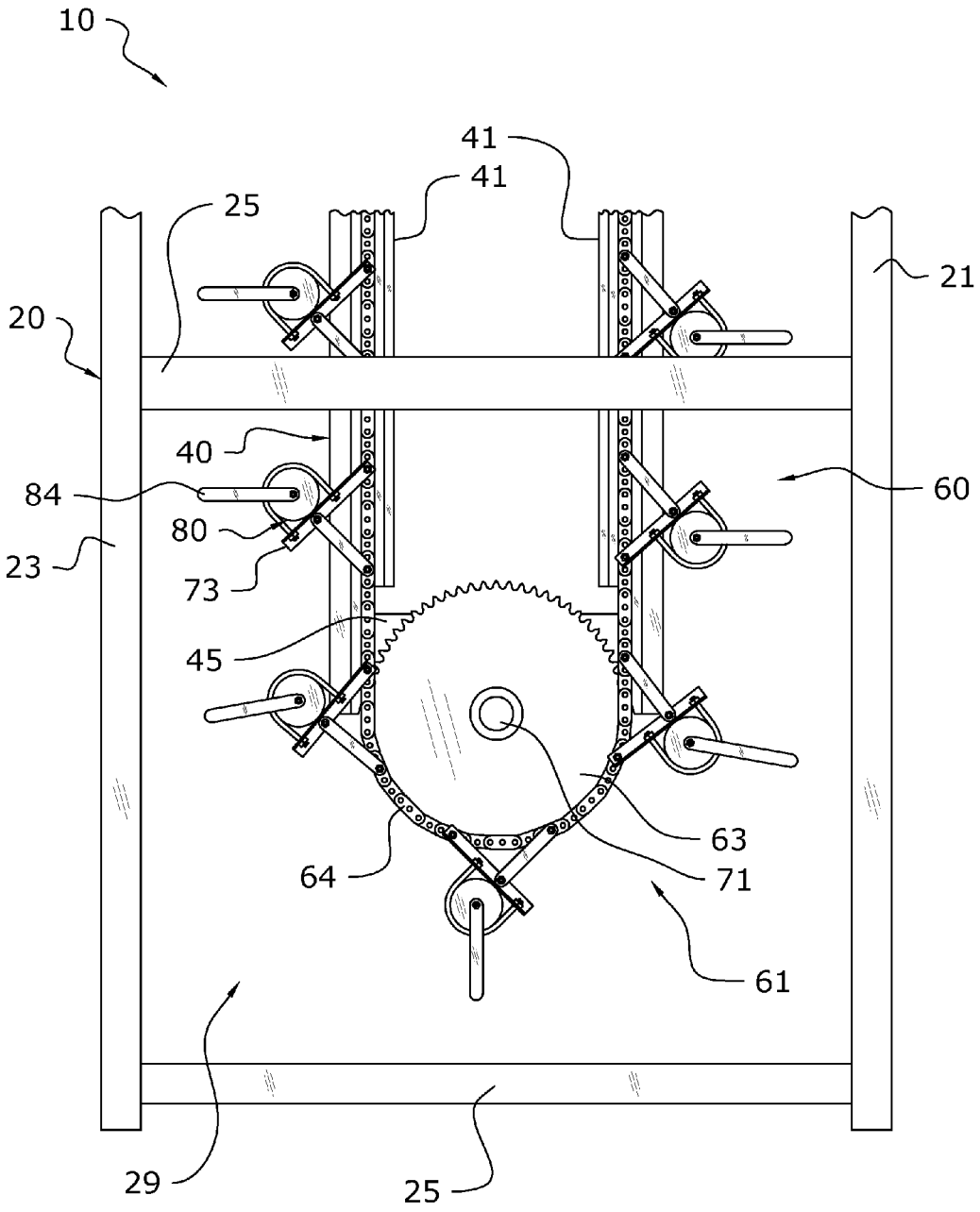
FIG. 5 is a magnified side view of the lower end of the present invention with the shell removed.
Figure 6:
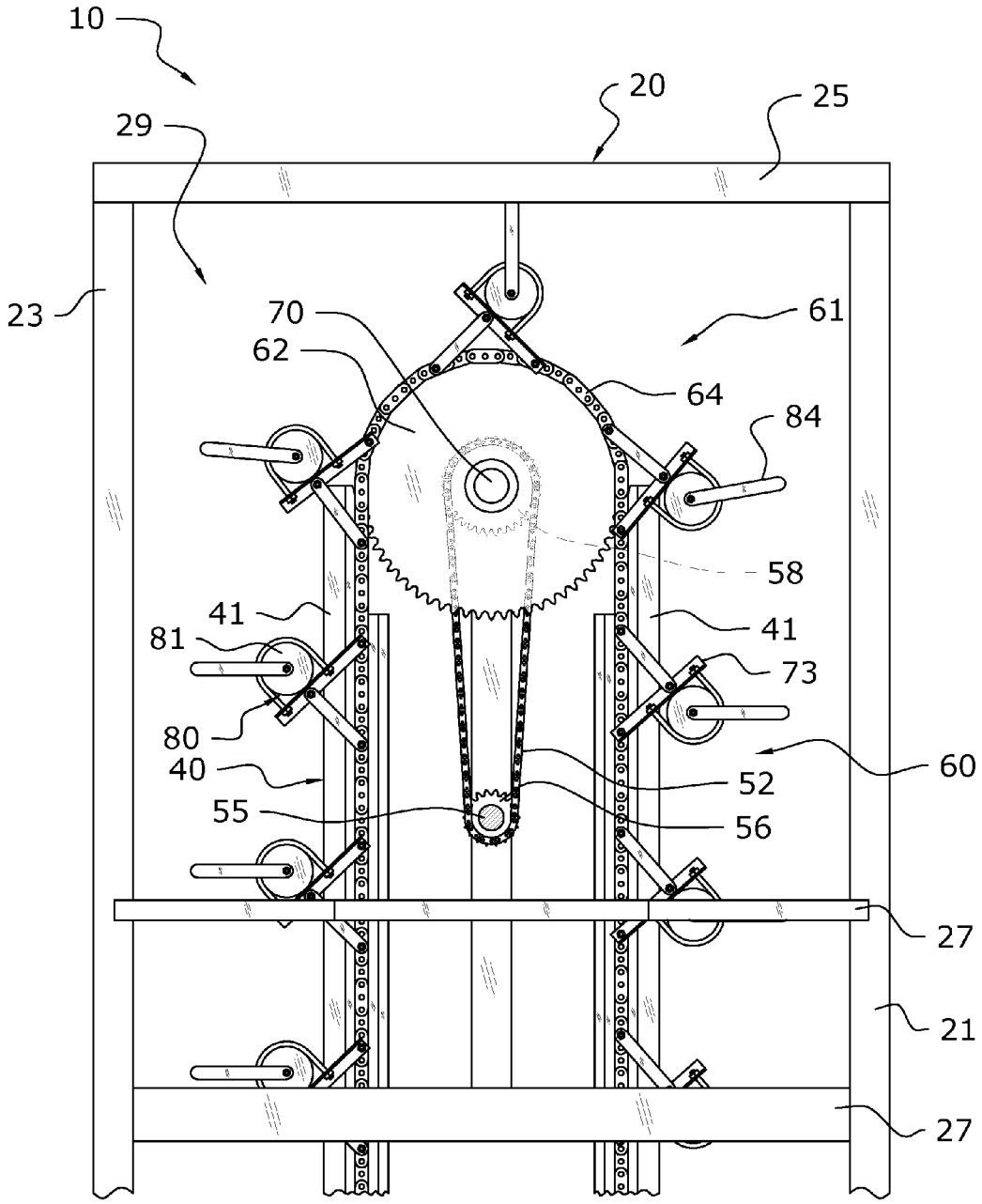
FIG. 6 is a magnified side view of the upper end of the present invention with the shell removed.
Figure 7:
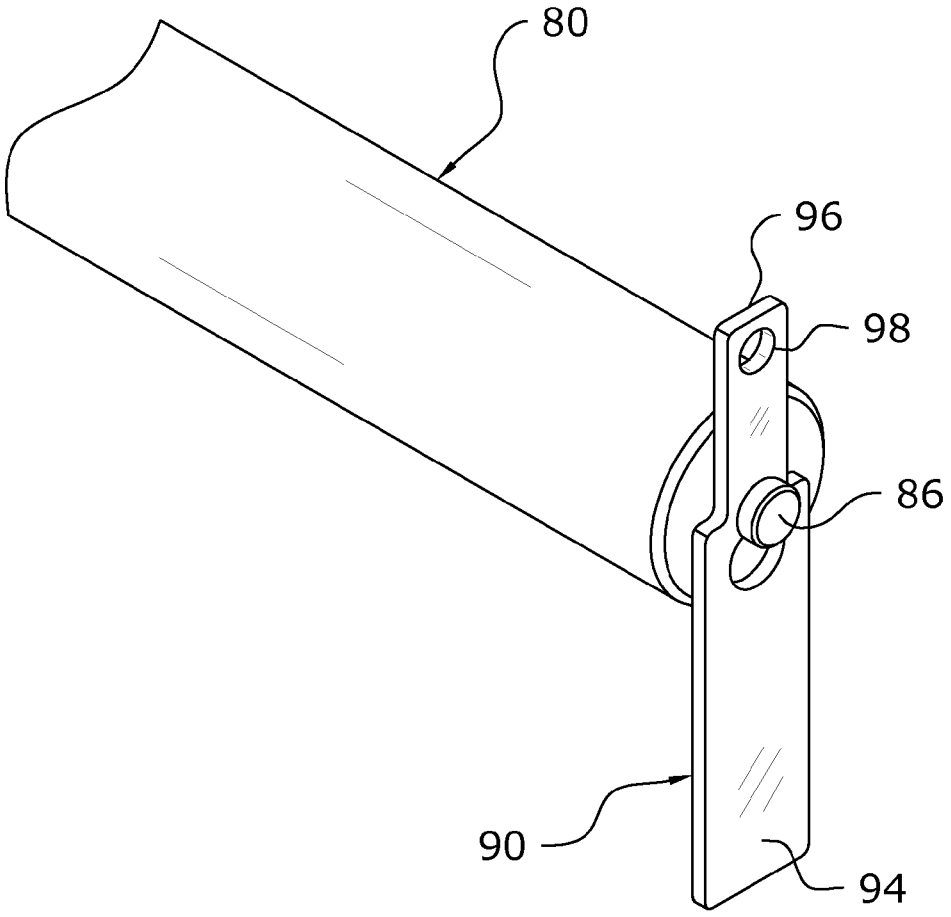
FIG. 7 is an upper perspective view of an alternative embodiment illustrating a removable stop member removably connected to the end of the mandrel.

The carousel 60 is supported by the internal frame structure 40 and circulates about the internal frame structure 40 and thus likewise circulates within the cavity 29 and about the external frame structure 20. The carousel 60 generally circulates in a vertically oriented manner wherein the carousel 60 travels substantially further in length in a vertical direction than in a horizontal direction. As shown in FIGS. 2 through 6 of the drawings, the carousel 60 includes a first vertical run and a second vertical run, wherein the first vertical run moves downwardly when the second vertical run moves upwardly. As shown in FIGS. 2 and 3 of the drawings, the carousel 60 is comprised of an elongated member, wherein the elongated member is an endless loop structure. It is appreciated that in locations with low ceilings or limited vertical space, a horizontally oriented carousel 60 and correspondingly oriented frame structures 20, 40 may be used.

The carousel 60 preferably has a first carrier assembly 61 and a second carrier assembly 66 for supporting the cantilever mandrels 80 near a longitudinal center. It is appreciated that more or less carrier assemblies may be used depending on the length and amount of cantilever mandrels 80. For example, when less cantilever mandrels 80 or shorter cantilever mandrels 80 are used, only one carrier assembly may be needed to provide adequate support to the cantilever mandrels 80. The first carrier assembly 61 and the second carrier assembly 66 rotate together and simultaneously. The first carrier assembly 61 and the second carrier assembly 66 are also comprised of a loop structure to operate in an endless circulating manner.

Each carrier assembly 61, 66 is comprised of a chain and sprocket structure and generally includes a drive sprocket 62, 67 preferably located at an upper end of the carrier assemblies 61, 66 and a secondary sprocket 63, 68 preferably located at a lower end. The drive sprocket 62 and the secondary sprocket 63 of the first carrier assembly 61 are connected via an elongated member 64 and the drive sprocket 67 and the secondary sprocket 68 of the second carrier assembly 66 are connected by a separate elongated member 69. The elongated members 64, 69 may be comprised of chains, pulleys, or various other types. Likewise, the sprockets 62, 63, 67, 68 may be comprised of gear shaped sprockets, pulleys, or various other types.

The drive sprockets 62, 67 of the first carrier assembly 61 and the second carrier assembly 66 are rotatably coupled via a connecting shaft 70 which also is connected to the sprocket 58 mechanically connected to the shaft 55 of the gearbox 54. It is appreciated that only one connecting shaft 70 is necessary in the case of a single drive assembly 50 as shown in the present invention, wherein each of the carrier assemblies 61, 66 operate simultaneously.

Each of the carrier assemblies 61, 66 also include a plurality of clamps 73, 74. The clamps 73, 74 are fixed to a respective elongated member 64, 69 and circulate with the elongated member 64, 69. The clamps 73, 74 also thus rotate as the elongated member 64, 69 changes directions, such as when moving around the lower end or the upper end of the carrier assembly 61, 66. The clamps 73, 74 are preferably comprised of a U-shaped clamp and are tightenable upon the cantilever mandrels 80 to secure the cantilever mandrels 80 to the carousel 60. The clamps 73, 74 preferably tighten the cantilever mandrels 80 upon the elongated member 64, 69 of the carousel 60 in a manner that prevents the cantilever mandrels 80 from rotating freely and forces the cantilever mandrels 80 to rotate with the clamps 73, 74 as the clamps 73, 74 are circulated with the elongated members 64, 69.

H. Cantilever Mandrels.

The present invention includes a plurality of cantilever mandrels 80 each for supporting at least one of the print cylinders 12 thereupon. The cantilever mandrels 80 are generally comprised of elongated tubular structures that extend the entire length of the cavity 29 of the external frame structure 20. The cantilever mandrels 80 are secured near a center of their longitudinal axis by the carousel 60 so that print cylinders 12 may be positioned upon a defined first portion 81 and second portion 82 of the cantilever mandrels 80. The first portion 81 and the second portion 82 are defined lengthwise by the carousel 60 and are accessible from respective end access openings 35. It is appreciated that instead of a first portion 81 and a second portion 82 to receive two separate print cylinders 12 each from an opposite end, the use of two cantilever mandrels 80 may linearly aligned with one another may be sufficient. The cantilever structure of the mandrels 80 is important to allow easy loading and unloading of the print cylinders 12 thereupon.

Each of the cantilever mandrels 80 also includes a retaining bracket 84, 85 extending from each end of the cantilever mandrels 80. The retaining bracket 84, 85 holds the respective print cylinders 12 upon cantilever mandrels 80 by extending over an outer end of the print cylinders 12. The retaining bracket 84, 85 is preferably comprised of an L-shaped structure. The retaining bracket 84, 85 also rotates with the cantilever mandrels 80 as the cantilever mandrels 80 are circulated about the carousel 60.

When respective cantilever mandrels 80 are moving substantially in a vertical direction, the retaining brackets 84, 85 extend in a general horizontal orientation which allows the retaining bracket 84, 85 to extend laterally past the outer end of the respective print cylinder 12 so as to retain the print cylinder 12 upon the cantilever mandrel 80. When the cantilever mandrels 80 are moving substantially in a horizontal direction, the retaining bracket 84, 85 extend in a general vertical orientation (via being rotated) which prevents the retaining bracket 84, 85 from extending past the outer end of the respective print cylinder 12 so as to allow the print cylinder 12 to be removed from the cantilever mandrel 80.

I. Removable Stop Members.

FIGS. 7 through 15 illustrate a portion of the cantilever 80 used in the present invention (FIG. 2 illustrates the entire cantilever 80). The cantilever 80 has an inner end that is anchored to a structure and an outer end that extends outwardly freely without being supported in a cantilevered manner. The cantilever 80 is adapated for removably receiving, supporting and allowing removal of a tubular object 12 such as but not limited to a print cylinder 12. The cantilever 80 is comprised of an elongated structure having a longitudinal axis.

Figure 15:
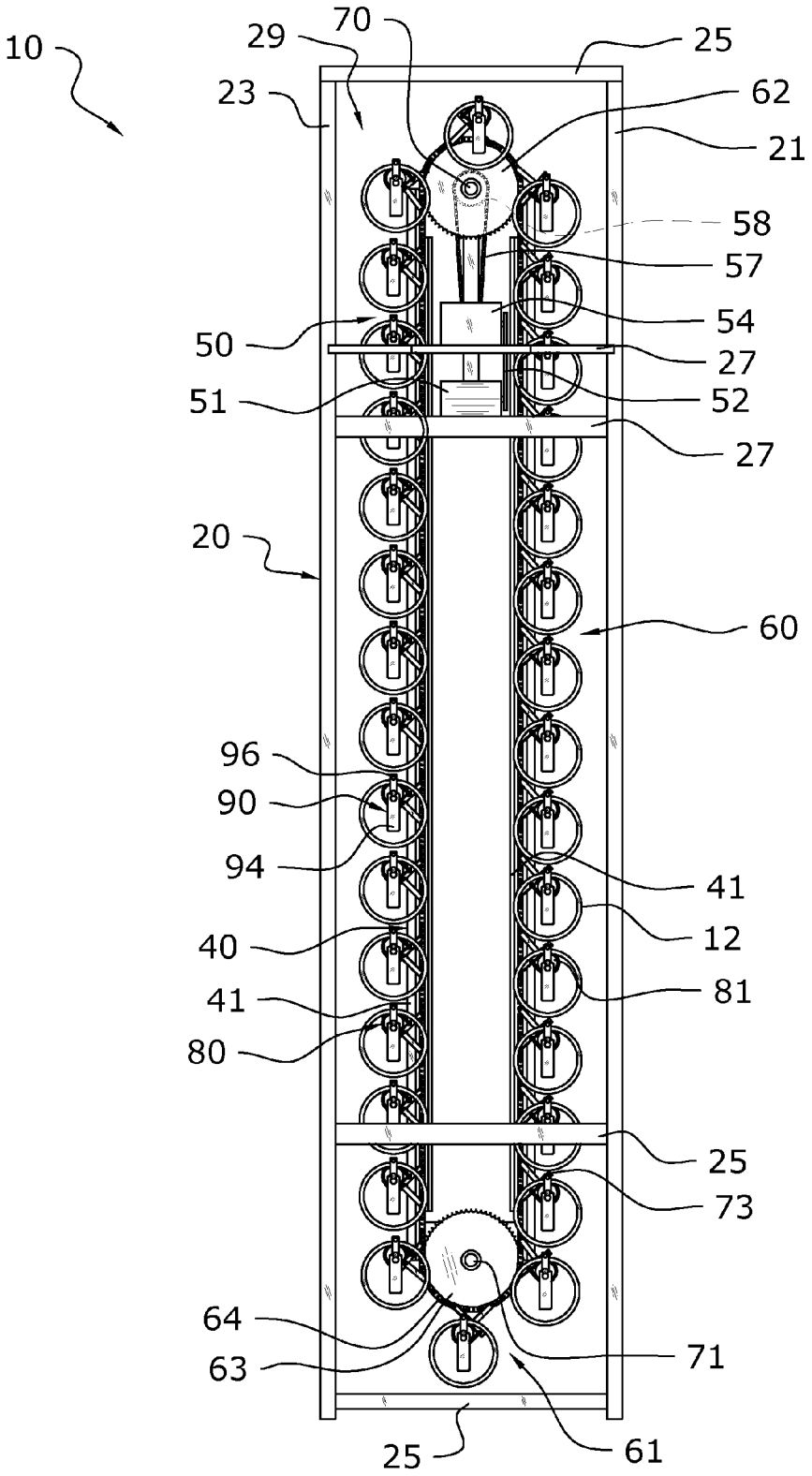
FIG. 15 is an end view of the stop members connected to the ends of the mandrels with the stop members extending vertically on all of the mandrels.

The cantilever 80 is preferably supported upon a carousel such as illustrated in FIG. 15, wherein the carousel circulates the cantilever 80 along a first vertical run and a second vertical run. The first vertical run moves downwardly when the second vertical run moves upwardly, and the first vertical run and the second vertical run are parallel with respect to one another. The first vertical run extends along a first vertically orientated plane and the second vertical run extends along a second vertically orientated plane as further shown in FIG. 15 of the drawings.

An end member 86 extends outwardly from the outer end of the cantilever 80. The end member 86 is preferably concentrically attached to the cantilever 80 so as the cantilever 80 rotates the end member 86 remains in a relatively constant position with respect to the end of the cantilever 80. The end member 86 is comprised of a shaft member 87 extending outwardly from the outer end of the cantilever 80. The distal end portion of the end member 86 is comprised of a head member that is broader than the shaft member 87 and extends radially outwardly from the shaft member 87 to define a receiver slot between the head member and the outer end of the cantilever 80 that rotatably receives the stop member 90. The receiver slot extends around the shaft member 87 and allows the stop member 90 to freely rotate about the end member 86 with the head member of the end member 86 preventing accidental removal of the stop member 90.

The head member has a cross sectional size greater than the shaft member 87. The shaft member 87 and the head member each preferably have a circular cross sectional shape, however, the head member may have a different cross sectional shape (e.g. square, oval) than the shaft member 87. The shaft member 87 preferably has a circular cross sectional shape to allow for rotation of the stop member 90 around the end member 86. The shaft member 87 has a diameter that is smaller than a diameter of the head member. The head member preferably has a diameter that is at least twenty-five percent greater than a diameter of the shaft member 87.

The stop member 90 has a connecting aperture 92 to allow a user to position the stop member 90 upon the end member 86 of the cantilever 80 and to remove the stop member 90 from the cantilever 80. The stop member 90 rotates upon the shaft member 87 of the end member 86 as the cantilever 80 moves along the carousel and rotates within the carousel. Each of the cantilevers 80 includes at least one stop member 90 to prevent the accidental removal of the tubular object 12.

The connecting aperture 92 has at least one portion having a size greater than a distal end portion of the end member 86 to allow the connecting aperture 92 to pass over the distal end portion of the end member 86. The connecting aperture 92 is preferably comprised of a lower portion and an upper portion, wherein a width of the lower portion is greater than a width of the upper portion. The width of the lower portion of the connecting aperture 92 is greater than a width of the head member to allow for positioning of the stop member 90 over the head member and removal from the head member. The width of the upper portion of the connecting aperture 92 is smaller than the width of the head member and larger than a width of the shaft member 87 to allow for free rotation of the stop member 90 upon the shaft member 87 of the end member 86 without the stop member 90 being removed.

Figure 8:
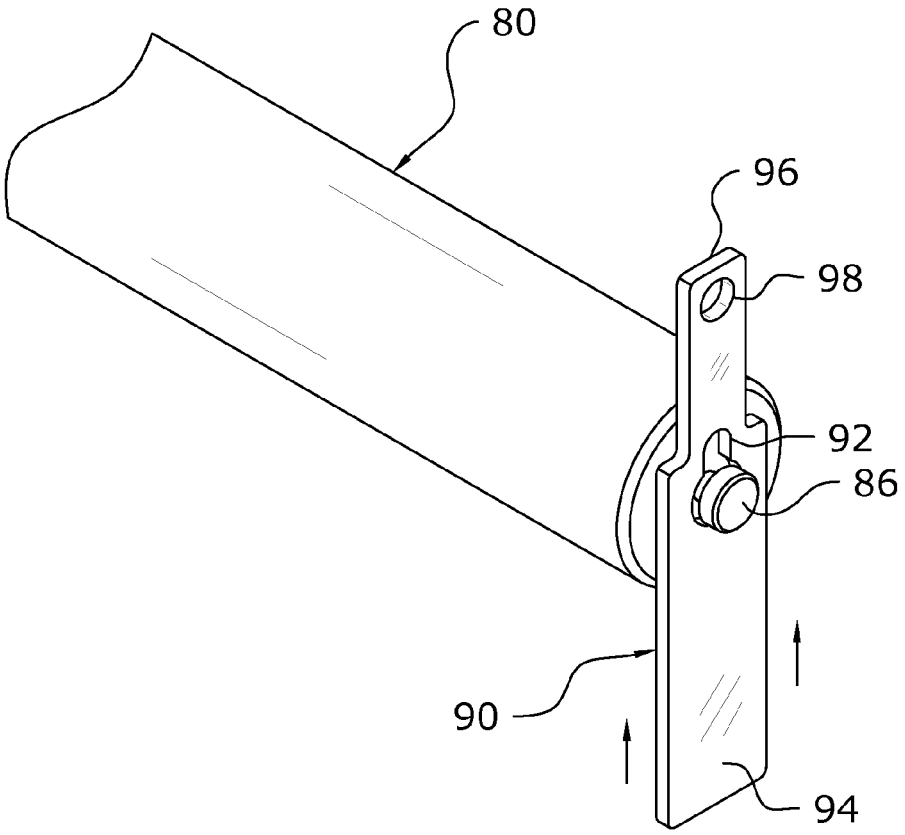
FIG. 8 is an upper perspective view of the stop member being lifted for removal.
Figure 14:
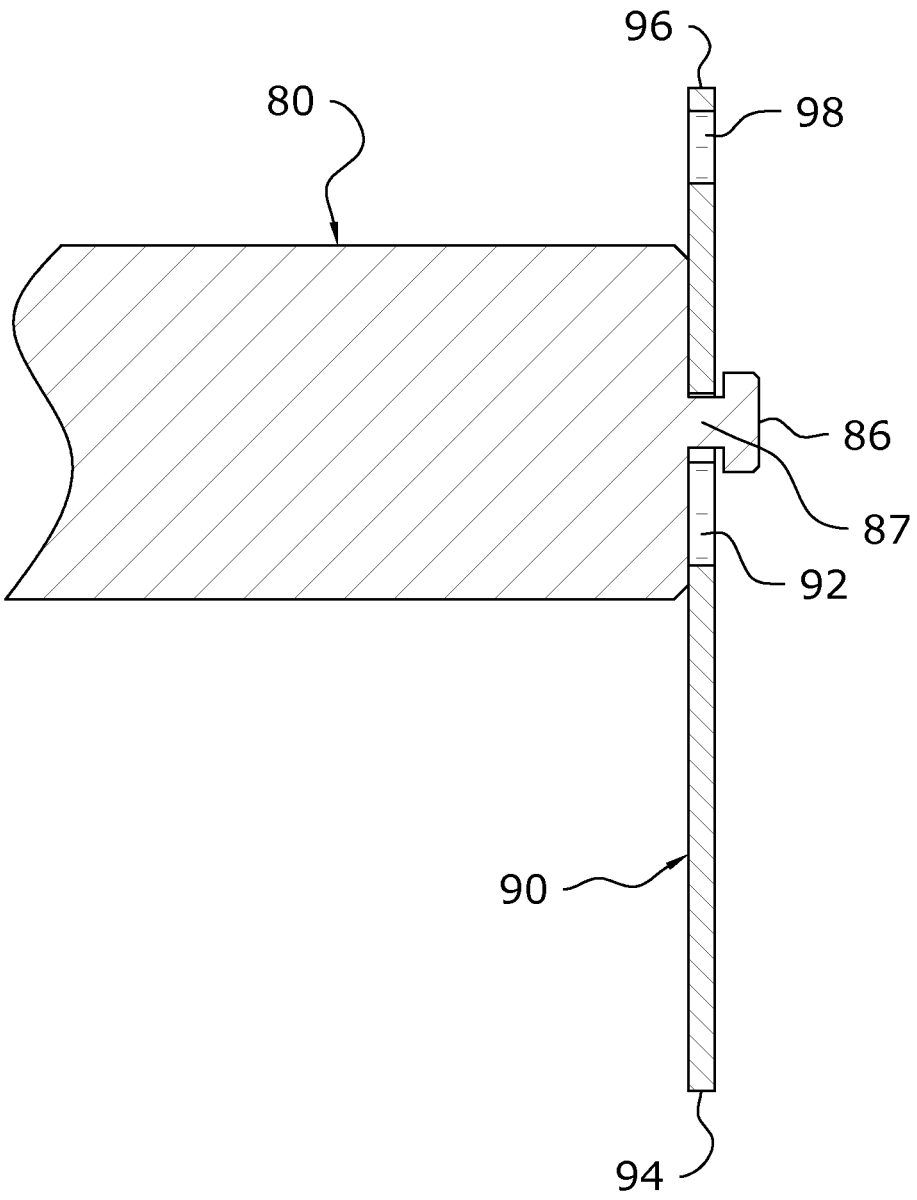
FIG. 14 is a side cutaway view of the mandrel and stop member illustrated in FIG. 13.

The stop member 90 is preferably comprised of a flat elongated structure that extends along a vertical axis that is transverse with respect to the longitudinal axis of the cantilever 80. The thickness of the stop member 90 is less than the distance between the head member and the outer end of the cantilever 80 as illustrated in FIG. 14 of the drawings. The stop member 90 is comprised of an upper segment 96 that extends above an upper surface of the cantilever 80 to retain the tubular object 12 upon the cantilever 80 until the user removes the stop member 90. The upper segment 96 has an upper end that is positioned above the upper surface of the cantilever 80 when the upper end of the connecting aperture 92 is resting upon the shaft member 87 of the end member 86 as illustrated in FIG. 8 of the drawings. It is further preferable that the upper end of the upper segment 96 extends above the upper surface of the tubular object 12 being supported upon the cantilever 80 as illustrated in FIG. 15. The stop member 90 is comprised of a lower segment 94 that extends downwardly from the upper segment 96, wherein the lower segment 94 provides a weight to offset the weight of the upper segment 96 thereby retaining the stop member 90 in a substantially vertical state with the upper segment 96 extending upwardly at all times. The upper segment 96 of the stop member 90 preferably includes an upper aperture 98 that a user may grasp to assist in the removal of the stop member 90.

The connecting aperture 92 is positioned between the lower segment 94 and the upper segment 96. A weight of the lower segment 94 is greater than a weight of the upper segment 96 to maintain the stop member 90 in a substantially vertically aligned position with the upper segment 96 extending upwardly. The stop member 90 rotates upon the shaft member 87 with the stop member 90 adapted to remain substantially vertically aligned regardless of the rotational position of the cantilever 80 as illustrated in FIG. 15 of the drawings.

J. Operation of First Embodiment.

In use of the invention illustrated in FIGS. 1 through 6, a first print cylinder 12 is positioned upon a lower most cantilever mandrel 80 upon a first portion 81 of the cantilever mandrel 80 so as to be retained by a respective first clamp 73 attached to the cantilever mandrel 80 and positioned near an inner end of the first print cylinder 12 and the other end positioned inwardly of a respective retaining bracket 84. Likewise, another print cylinder 12 is positioned upon the lower most cantilever mandrel 80 upon a second portion 82 of the cantilever mandrel 80 in a similar manner. The first print cylinder 12 is positioned upon the first portion 81 of the cantilever mandrel 80 via extending the first print cylinder 12 through access opening 35 on a respective end and the other print cylinder 12 is positioned upon the second portion 82 of the cantilever mandrel 80 via extending the second print cylinder 12 through access opening 35 on an opposite end of the shell 30 and external frame structure 20.

The controller 39 is then operated to circulate the carousel 60 so that another cantilever mandrel 80 moves to the lowermost position and a respective pair of retaining brackets 84, 85 move to a vertical position so that another first and second print cylinder 12 may be slid upon the new lowermost cantilever mandrel 80. It is appreciated that the previously loaded first and second print cylinder 12 are now circulated slightly in an upward direction causing the respective retaining brackets 84, 85 to move laterally across an outer end of the first and second print cylinders 12 to retain the first and second print cylinders 12 upon the first and second portion 81, 82 of the cantilever mandrels 80.

The carousel 60 is continued to be circulated until each of the cantilever mandrels 80 have a print cylinder 12 upon both a first portion 81 and a second portion 82 of the cantilever mandrel 80. It is appreciated that the preferred manner in which the cantilever mandrel 80 is circulated is the motor 51 causing the gearbox 54 to rotate the shaft 55 which in turn transfers rotational force to the drive sprocket 62 of the first carrier assembly 61 through the mechanically connected sprockets 56, 58 and elongated member 57. The rotation of the drive sprocket 62 of the first carrier assembly 61 causes the entire first carrier assembly 61 and the second carrier assembly 66 to circulate thus circulating the attached cantilever mandrels 80.

K. Operation of Second Embodiment.

Figure 9:
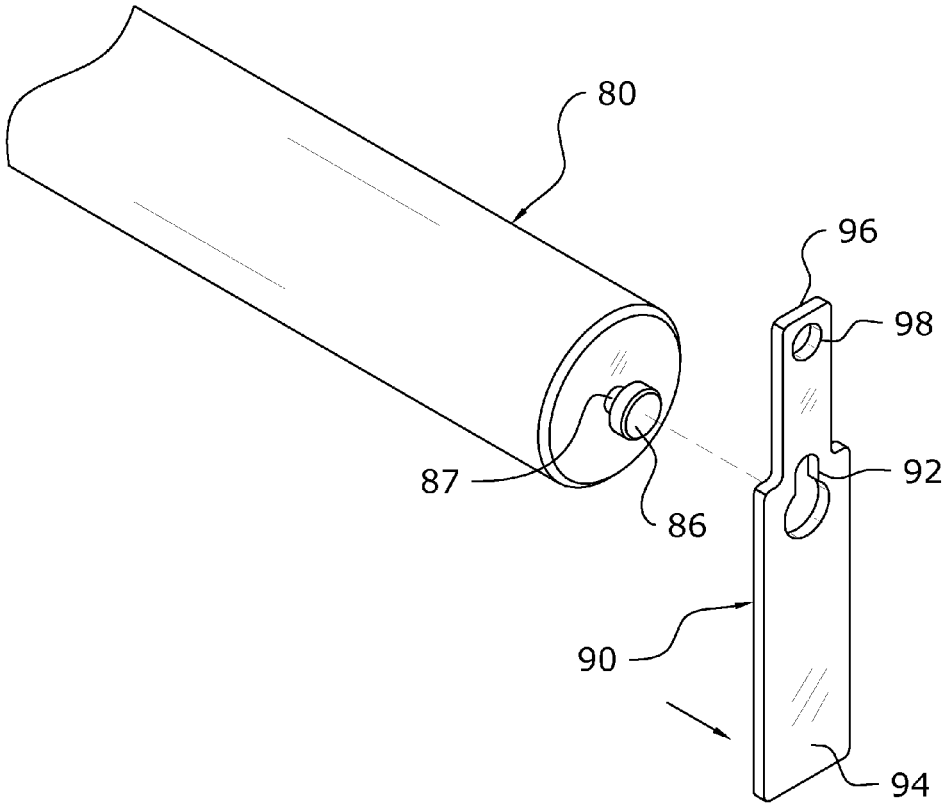
FIG. 9 is an exploded upper perspective view of the stop member.
Figure 10:
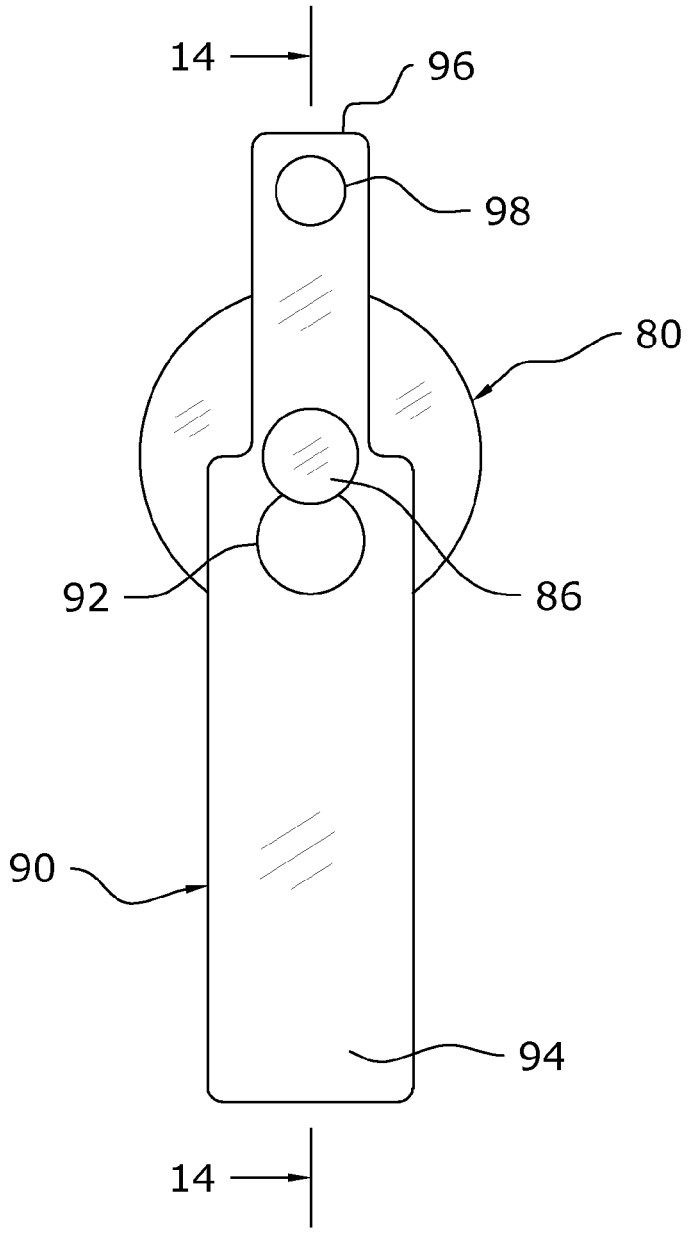
FIG. 10 is an end view of the mandrel with the stop member connected to the end member.
Figure 11:
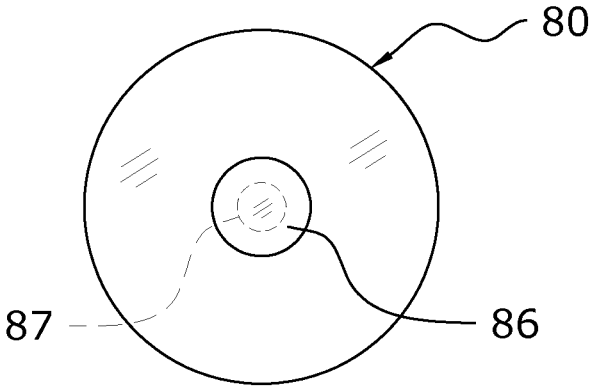
FIG. 11 is an end view of the mandrel with the end member extending from the end thereof.
Figure 12:
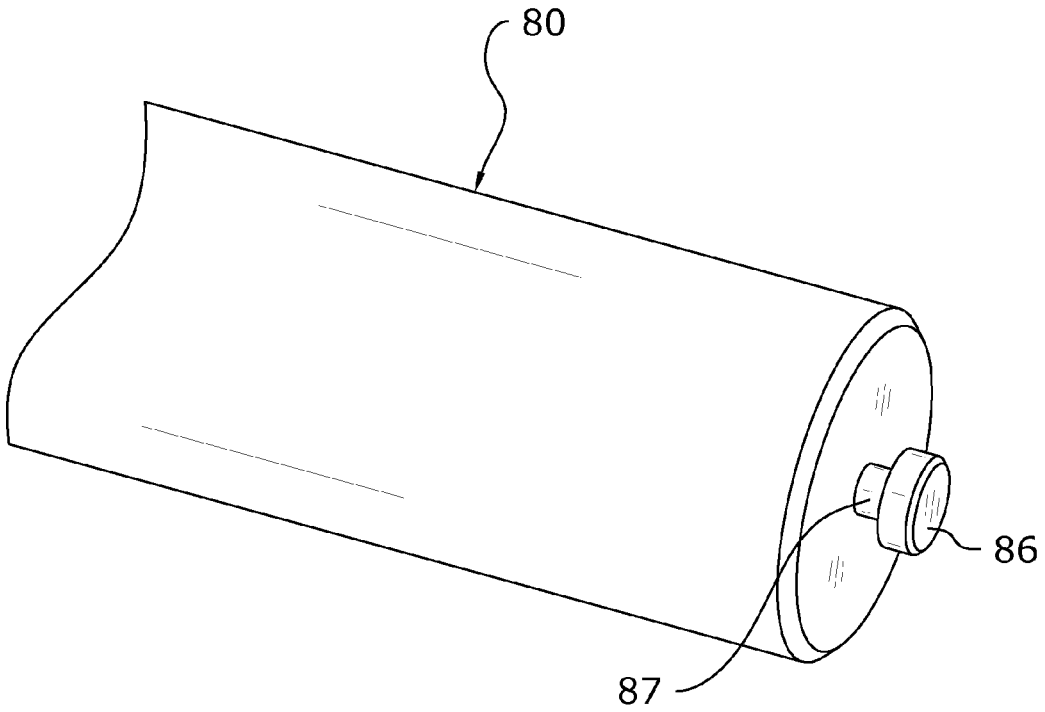
FIG. 12 is an upper perspective view of the mandrel illustrating the end member.
Figure 13:
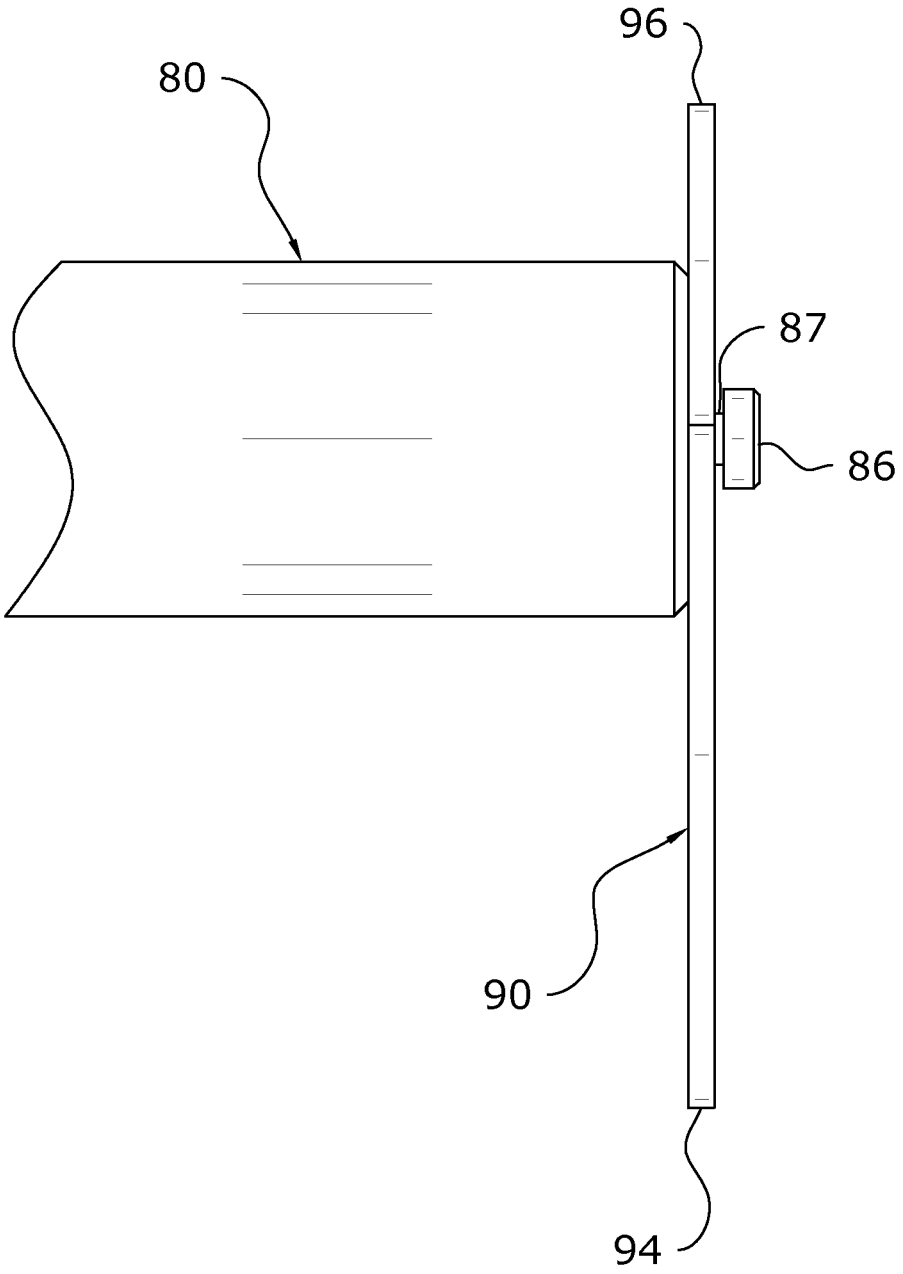
FIG. 13 is a magnified side view of an end of the mandrel with the stop member connected to the end member.

In use of the invention illustrated in FIGS. 7 through 15, the stop member 90 is utilized to selectively retain the tubular object upon the cantilever 80 during operation of the carousel similar to the retaining brackets 84 discussed previously. To load a tubular object 12 such as a print cylinder 12, the user lifts up on the stop member 90 to align the lower portion of the connecting aperture 92 with the end member 86 and then removes the stop member 90 as illustrated in FIGS. 8 and 9. The tubular object 12 is positioned upon the cantilever 80 from the outer end of the cantilever 80 and then the stop member 90 is repositioned upon the end member 86 by aligning the lower portion of the connecting aperture 92 with the end member 86. Once the stop member 90 is positioned upon the end member 86, the user allows the stop member 90 to fall down so that the upper portion of the connecting aperture 92 is positioned around the shaft member 87 of the end member 86 with the upper inner edge of the connecting aperture 92 contacting the upper surface of the shaft member 87. The upper segment 96 of the stop member 90 prevents the removal of the tubular object 12 from the cantilever 80. As the cantilever 80 is rotated around the carousel, the cantilever 80 will rotate. As the cantilever 80 rotates, the stop member 90 will retain a substantially vertical alignment at all times along the entire run of the carousel to prevent the removal of the tubular object from the cantilever 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A cantilever apparatus for removably supporting a tubular object, comprising:

a cantilever having an inner end and an outer end, wherein said cantilever is adapted to removably receive a tubular object;

an end member extending outwardly from said outer end of said cantilever, wherein said end member includes a distal end portion;

wherein said end member is comprised of a shaft member extending outwardly from said outer end of said cantilever and wherein said distal end portion is comprised of a head member; and a stop member having a connecting aperture, wherein said connecting aperture is comprised of a lower portion and an upper portion, wherein a width of said lower portion is greater than a width of said upper portion, and wherein said lower portion of said connecting aperture has a size greater than said distal end portion of said end member to allow said connecting aperture to pass over said distal end portion of said end member;

wherein said cantilever is supported upon a carousel, wherein said carousel circulates said cantilever along a first vertical run and a second vertical run, wherein said first vertical run moves downwardly when said second vertical run moves upwardly, wherein said first vertical run and said second vertical run are parallel with respect to one another, wherein said first vertical run extends along a first vertically orientated plane, and wherein said second vertical run extends along a second vertically orientated plane.

2. The cantilever apparatus of claim 1, wherein said tubular object is comprised of a print cylinder.

3. The cantilever apparatus of claim 1, wherein said cantilever is comprised of an elongated structure having a longitudinal axis.

4. The cantilever apparatus of claim 1, wherein said end member is concentrically attached to said cantilever.

5. The cantilever apparatus of claim 1, wherein said head member has a cross sectional size greater than said shaft member.

6. The cantilever apparatus of claim 5, wherein said shaft member and said head member each have a circular cross sectional shape.

7. The cantilever apparatus of claim 6, wherein said shaft member has a diameter that is smaller than a diameter of said head member.

8. The cantilever apparatus of claim 6, wherein said head member has a diameter that is at least twenty-five percent greater than a diameter of said shaft member.

9. The cantilever apparatus of claim 1, wherein said width of said upper portion of said connecting aperture is smaller than said width of said head member and larger than a width of said shaft member.

10. The cantilever apparatus of claim 1, wherein said stop member rotates upon said shaft member.

11. The cantilever apparatus of claim 1, wherein said stop member is comprised of an upper segment that extends above an upper surface of said cantilever.

12. The cantilever apparatus of claim 11, wherein said stop member is comprised of a lower segment that extends downwardly from said upper segment.

13. The cantilever apparatus of claim 12, wherein said connecting aperture is positioned between said lower segment and said upper segment, wherein a weight of said lower segment is greater than a weight of said upper segment to maintain said stop member in a substantially vertically aligned position with said upper segment extending upwardly.

14. The cantilever apparatus of claim 11, wherein said stop member rotates upon said shaft member and wherein said stop member is adapted to remain substantially vertically aligned regardless of the rotational position of said cantilever.

15. A cantilever apparatus for removably supporting a tubular object, comprising:

a cantilever having an inner end and an outer end, wherein said cantilever is comprised of an elongated structure having a longitudinal axis, wherein said cantilever is adapted to removably receive a tubular object and wherein said tubular object is comprised of a print cylinder;

an end member extending outwardly from said outer end of said cantilever; and a stop member having a connecting aperture, wherein said connecting aperture has at least a portion having a size greater than a distal end portion of said end member to allow said connecting aperture to pass over said distal end portion of said end member;

wherein said end member is comprised of a shaft member extending outwardly from said outer end of said cantilever and wherein said distal end portion is comprised of a head member;

wherein said stop member rotates upon said shaft member;

wherein said head member has a cross sectional size greater than said shaft member;

wherein said connecting aperture is comprised of a lower portion and an upper portion, wherein a width of said lower portion is greater than a width of said upper portion;

wherein said width of said lower portion of said connecting aperture is greater than a width of said head member;

wherein said width of said upper portion of said connecting aperture is smaller than said width of said head member and larger than a width of said shaft member;

wherein said cantilever is supported upon a carousel, wherein said carousel circulates said cantilever along a first vertical run and a second vertical run, wherein said first vertical run moves downwardly when said second vertical run moves upwardly, wherein said first vertical run and said second vertical run are parallel with respect to one another, wherein said first vertical run extends along a first vertically orientated plane, and wherein said second vertical run extends along a second vertically orientated plane.

16. The cantilever apparatus of claim 15, wherein said end member is concentrically attached to said cantilever.

17. A cantilever apparatus for removably supporting a tubular object, comprising:

a cantilever having an inner end and an outer end, wherein said cantilever is comprised of an elongated structure having a longitudinal axis, wherein said cantilever is adapted to removably receive a tubular object and wherein said tubular object is comprised of a print cylinder;

wherein said cantilever is supported upon a carousel, wherein said carousel circulates said cantilever along a first vertical run and a second vertical run, wherein said first vertical run moves downwardly when said second vertical run moves upwardly, wherein said first vertical run and said second vertical run are parallel with respect to one another, wherein said first vertical run extends along a first vertically orientated plane, and wherein said second vertical run extends along a second vertically orientated plane;

an end member extending outwardly from said outer end of said cantilever, wherein said end member is concentrically attached to said cantilever; and a stop member having a connecting aperture, wherein said connecting aperture has at least a portion having a size greater than a distal end portion of said end member to allow said connecting aperture to pass over said distal end portion of said end member;

wherein said end member is comprised of a shaft member extending outwardly from said outer end of said cantilever and wherein said distal end portion is comprised of a head member;

wherein said stop member rotates upon said shaft member and wherein said stop member is adapted to remain substantially vertically aligned regardless of the rotational position of said cantilever;

wherein said head member has a cross sectional size greater than said shaft member;

wherein said connecting aperture is comprised of a lower portion and an upper portion, wherein a width of said lower portion is greater than a width of said upper portion;

wherein said width of said lower portion of said connecting aperture is greater than a width of said head member;

wherein said width of said upper portion of said connecting aperture is smaller than said width of said head member and larger than a width of said shaft member;

wherein said shaft member and said head member each have a circular cross sectional shape;

wherein said shaft member has a diameter that is smaller than a diameter of said head member;

wherein said head member has a diameter that is at least twenty-five percent greater than a diameter of said shaft member;

wherein said stop member is comprised of an upper segment that extends above an upper surface of said cantilever;

wherein said stop member is comprised of a lower segment that extends downwardly from said upper segment;

wherein said connecting aperture is positioned between said lower segment and said upper segment, wherein a weight of said lower segment is greater than a weight of said upper segment to maintain said stop member in a substantially vertically aligned position with said upper segment extending upwardly.

* * * * *